US009085974B2

(12) United States Patent
Schreiber et al.

(10) Patent No.: US 9,085,974 B2
(45) Date of Patent: Jul. 21, 2015

(54) STIMULATING SUBTERRANEAN ZONES

(75) Inventors: Robert J. Schreiber, Williston, ND (US); Wesley J. Tucker, Williston, ND (US)

(73) Assignee: Halliburton Energy Services, Inc., Houston, TX (US)

( * ) Notice: Subject to any disclaimer, the term of this patent is extended or adjusted under 35 U.S.C. 154(b) by 858 days.

(21) Appl. No.: 12/462,735

(22) Filed: Aug. 7, 2009

(65) Prior Publication Data

US 2011/0030947 A1 Feb. 10, 2011

(51) Int. Cl.

| | |
|---|---|
| ***E21B 43/14*** | (2006.01) |
| ***E21B 43/25*** | (2006.01) |
| ***E21B 34/14*** | (2006.01) |
| ***E21B 33/138*** | (2006.01) |

(52) U.S. Cl.

CPC ..... *E21B 43/25* (2013.01); *E21B 33/138* (2013.01); *E21B 34/14* (2013.01)

(58) Field of Classification Search

CPC ... E21B 34/14; E21B 21/10; E21B 2034/007; E21B 43/14; E21B 43/25

USPC ..... 166/318, 193, 239; 175/237, 268, 270, 175/271

See application file for complete search history.

(56) References Cited

U.S. PATENT DOCUMENTS

| | | | | |
|---|---|---|---|---|
| 4,194,566 | A * | 3/1980 | Maly | 166/307 |
| 4,928,520 | A * | 5/1990 | Barrington | 73/152.57 |
| 5,758,726 | A | 6/1998 | Streich et al. | |
| 5,829,523 | A | 11/1998 | North | |
| 6,634,426 | B2 * | 10/2003 | McCoy et al. | 166/254.1 |
| 7,387,165 | B2 * | 6/2008 | Lopez de Cardenas et al. | 166/313 |
| 8,561,700 | B1 | 10/2013 | Barbee, Jr. | |
| 2008/0047707 | A1 * | 2/2008 | Boney et al. | 166/270 |
| 2008/0164031 | A1 * | 7/2008 | Howell et al. | 166/305.1 |
| 2008/0223587 | A1 * | 9/2008 | Cherewyk | 166/386 |
| 2013/0014936 | A1 | 1/2013 | Griffith | |

* cited by examiner

*Primary Examiner* — Shane Bomar
*Assistant Examiner* — Kipp Wallace
(74) *Attorney, Agent, or Firm* — John W. Wustenberg; Fish & Richardson P.C.

(57) ABSTRACT

In some implementations, a method for stimulating a subterranean zone includes pumping stimulation fluid through a tubing string in a wellbore during a stimulation process. The tubing string includes a plurality of sleeves with each associated with a different treatment zone of the subterranean zone. A time for each of a plurality of different sealers entering the tubing string is detected. Each of the plurality of different sealers is associated with a different one of the plurality of sleeves. A location of the plurality of different sealers in the tubing string is substantially determined based, at least in part, on the associated entry time.

25 Claims, 16 Drawing Sheets

STIMULATING SUBTERRANEAN ZONES

TECHNICAL FIELD

This invention relates to subterranean production and, more particularly, to stimulating subterranean zones.

BACKGROUND

Before, and even after a casing is installed in a wellbore, the well may be treated or stimulated. Stimulation involves pumping stimulation fluids such as fracturing fluids, acid, cleaning chemicals, and/or proppant laden fluids into the formation to improve wellbore production. The stimulation fluids are pumped through the casing and then into the wellbore. If the casing is installed and more than one zone of interest of the formation is treated, tools must be run into the casing to isolate fluid flow at each zone.

Instead of stimulating the formation after installing casing, the well operator may choose to stimulate an uncased portion of a wellbore. To do so, the operator may run a liner extending from the surface into the uncased section of the wellbore with inflatable element packers to isolate the portions of the wellbore. Multiple packers allow the operator to isolate segments of the uncased portion of the wellbore so that each segment may be individually treated to concentrate and control fluid treatment along the wellbore.

The tubing string, which conveys the treatment fluid, can include ports or openings for the fluid to pass into the wellbore. Where more concentrated fluid treatment is desired in one position along the wellbore, a small number of larger ports may be used. Where it is desired to distribute treatment fluids over a greater area, a perforated tubing string may be used having a plurality of spaced apart perforations through its wall. The perforations can be distributed along the length of the tube or only at selected segments. The open area of each perforation can be pre-selected to control the volume of fluid passing from the tube during use.

Another method of treating a formation with or without an uncased wellbore involves running a non-casing fluid treatment tubing string with packers into the wellbore. The string includes at least one section of ports that are openable when desired to permit fluid flow into the wellbore. A sleeve or sleeves are located inside the tubing at each section of ports in the tubing and include ports that correspond with the ports in the tubing. The sleeves are initially axially offset from the tubing ports so that the tubing ports are closed to fluid flow. The sleeves include annular seats of differing diameters. To open a given set of ports, at least one packer is set to isolate the annulus between the tubing string and the formation or casing around the section of ports. A ball is then pumped down and landed on the annular seat of the given sleeve. If more than one sleeve is used, the diameters of the annular seats are staged with decreasing diameters. Thus, a ball with a diameter for landing on the given sleeve will pass through the annular seats of any previous sleeves as is passes through the tubing. With the ball landed on the annular seat of the desired sleeve, fluid pressure is applied to form a seal preventing fluid flow past the sleeve. The fluid pressure also moves the sleeve axially, thus matching up the ports in the sleeve with the ports in the tubing and allowing fluid flow from the tubing to pass through the sleeve ports, through the tubing ports, and into the wellbore.

SUMMARY

The present disclosure is directed to a system and method for stimulating subterranean zones. In some implementations, a method for stimulating a subterranean zone includes pumping stimulation fluid through a tubing string in a wellbore during a stimulation process. The tubing string includes a plurality of sleeves with each associated with a different treatment zone of the subterranean zone. A time for each of a plurality of different sealers entering the tubing string is detected. Each of the plurality of different sealers is associated with a different one of the plurality of sleeves. A location of the plurality of different sealers in the tubing string is substantially determined based, at least in part, on the associated entry time.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
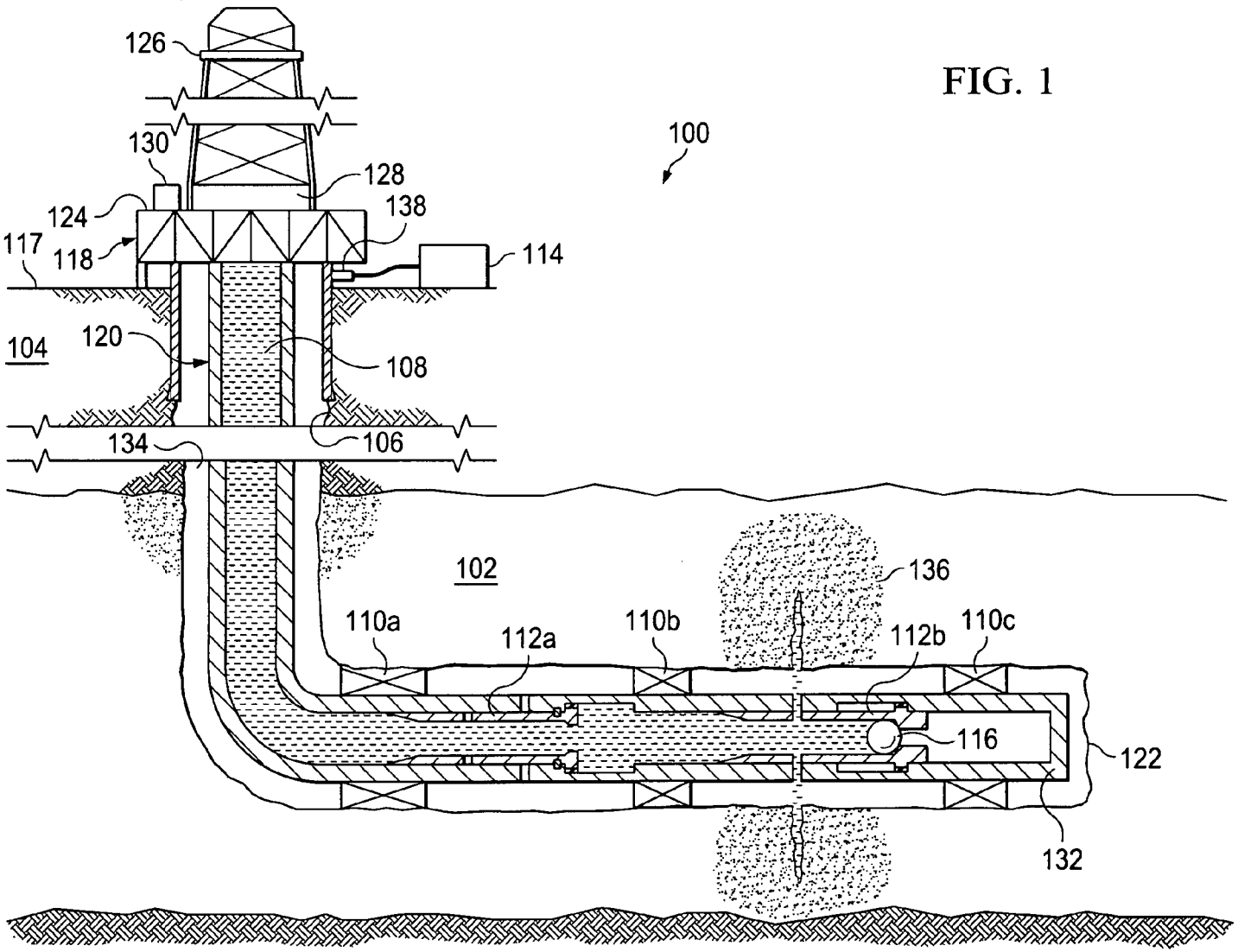
FIG. 1 is an example well system for stimulating subterranean zones in accordance with some implementations of the present disclosure.

FIG. 1 is a cross-sectional view of an example well system 100 for managing stimulation of a subterranean zone. For example, the system 100 may stimulate multiple treatment zones using sealers to isolate the different treatment zones. Sealers are typically designed to substantially seal perforations in, for example, casings and may divert fluid to other portions of a subterranean zone. For example, the sealers may include mechanical sealers for tubing string sections. In some implementations, the sealers may include ball sealers or frac balls included in treatment fluid and pumped through a casing. Frac balls may be used in connection with slidable elements that slide or otherwise move to form an opening in response to receiving an associated frac ball. In these instances, the frac ball may substantially seal the casing once engaged in the slidable element, and the pressure formed from this seal may slide the slidable element to form an opening to the subterranean zone. Once opened, the fluid pumped through the casing may be diverted to at least a portion of the subterranean zone proximate the openings. For example, the diverted fluid may stimulate the subterranean formation to initiate, accelerate or otherwise activate hydrocarbon production. In some implementations, the system 100 may monitor the stimulation process based on determining a time that different sealers enter a casing. By detecting entry of sealers into the casing and modeling or otherwise determining the location of the sealers in the casing, the system 100 may minimize or otherwise reduce cost and/or time needed to stimulate a subterranean formation. For example, the estimated location or time of arrival of a sealer at a sleeve may be compared with detected operation conditions to verify a stimulation process is operating according to specified parameters. In addition, the system 100 may maximize, enhance or otherwise increase the accuracy of the treatment of the different treatment zones. Also, the system 100 may continuously operate through a plurality of different intervals (e.g., 11) without stopping operation by determining the locations of sealers in the casing. In other words, the system 100 may continuously operate while stimulating a plurality of different portions of a subterranean zone. In addition, the system 100 may be used in vertical, horizontal, and/or divergent bores.

In some implementations, the well system 100 includes a production zone 102, a non-production zone 104, a wellbore 106, treatment fluid 108, packers 110, moveable sleeves 112 and a monitoring system 114. The production zone 102 may be a subterranean formation including resources (e.g., oil, gas, water) and may include multiple zones. The non-production zone 104 may be one or more formations that are isolated from the wellbore 106 using, for example, the packers 110. For example, the zone 104 may include contaminants that, if mixed with the resources, may result in requiring additional processing of the resources and/or make production economically unviable. The packers 110 may be selectively positioned in the wellbore 106, and the setting of the packers 110 may be activated using, for example, a fluid, prechannel setting, pump pressure, and/or other events. For example, the packers 110 may swell in response to at least contact with a specific fluid (e.g., water). The moveable sleeves 112 may move between a plurality of different positions. For example, the moveable sleeve valve 112 may include a first position that substantially prevents treatment fluid 108 from contacting the production zone 102, as illustrated by the sleeve valve 112*a*, and a second position that releases the fluid 108 into the production zone 102, as illustrated by the sleeve valve 112*b*. The monitoring system 114 may determine an initial time that the treatment fluid 108 contacts the production zone 102 and/or monitor operating conditions of a stimulation process. In some implementations, the monitoring system 114 can generate a model based, at least in part, on a plurality of different parameters and determine a time that sleeve valve 112 releases the treatment fluid. For example, the monitoring system 114 may detect a ball drop and determine an approximate time that the dropped ball 116 switches the sleeve valve 112*b* to an open position. In some implementations, a ball drop includes a time that a sealer enters a wellhead and/or initial portion of a tubing string. In doing so, the monitoring system 114 may enable the system 100 to continuously operate while treating different portions of subterranean zone 102.

Turning to a more detailed description of the elements of system 100, the wellbore 106 extends from a surface 117 to the production zone 102. The wellbore 106 may include a rig 118 that is disposed proximate to the surface 117. The rig 118 may be coupled to a tubing string 120 that extends a substantial portion of the length of the wellbore 106 from about the surface 117 towards the production zones 102 (e.g., hydrocarbon-containing reservoir). The tubing string 120 may extend to proximate a terminus 122 of the wellbore 106. In some implementations, the wellbore 106 may be completed with the tubing string 120 extending to a predetermined depth to the production zone 102 and then extending substantially horizontally through the production zone 102. In some implementations, the wellbore 106 may include other portions that are horizontal, slanted or otherwise deviated from vertical.

The rig 118 may be centered over a subterranean oil or gas formation or production zone 102 located below the earth's surface 117. The rig 118 includes a work deck 124 that supports a derrick 126. The derrick 126 supports a hoisting apparatus 128 for raising and lowering pipe strings such as tubing string 120. Pump 130 is capable of pumping a variety of wellbore compositions (e.g., stimulation fluid, drilling fluid, cement) into the well and includes a pressure measurement device that provides a pressure reading at the pump discharge. Upon completion of wellbore drilling, the tubing string 120 is often placed in the wellbore 106 to deliver or otherwise release treatment fluid 108 into at least a portion of the production zone 102. The treatment fluid 108 may include one or more of acid, gelled acid, gelled water, gelled oil, carbon dioxide, nitrogen, and/or any of these fluids containing proppants (e.g., sand, bauxite). The tubing string 120 is a string of pipes including the packers 110 and the sleeves 112 that extends down the wellbore 106, through which oil and gas will eventually be extracted. A float shoe 132 is typically attached to the end of the casing string when the casing string is run into the wellbore. The float shoe 132 guides the tubing string 120 toward the center of the hole and may minimize or otherwise decrease problems associated with hitting rock ledges or washouts in the wellbore 106 as the casing string is lowered into the well. In some implementations, the casing shoe 132 may be a guide shoe that typically includes a tapered, often bullet-nosed piece of equipment found on the bottom of the tubing string 120. The region between tubing string 120 and the wall of wellbore 106 is known as the casing annulus 134.

The sets of sleeves 112 are used in the wellbore 106 to substantially control fluid communication between an interior of the tubing string 120 and treatment zones 136 of at least the production zone 102 intersected by the wellbore 106. Any number of treatment zones 136 may be produced from, or injected into, using the well system 100. In some implementations, each sleeve valve 112 may include a screen, at least one valve, and associated packers 110. The annulus 134 between the associated packers 110 and the tubing string 120 and the wall of the wellbore 106 may be substantially isolated from the released treatment fluid 108 of adjacent portions of the annulus 134. The sleeve valve 112 may be selectively switched between permitting and substantially preventing fluid communication between the interior and exterior of the tubing string 120 and the treatment zone 136. In other words, the sleeves 112 may control fluid flow between the interior of the tubing string 120 and the annulus 134 between the associated packer 110 such as 110*b* and 110*c*. A suitable sleeve valve 112 may include the DELTA STIM™ sleeve valve available from Halliburton Energy Services of Houston, Tex.

The monitoring system 114 can include any software, hardware, and/or firmware that substantially controls stimulation of the production zone 102. For example, the monitoring system 114 may, during stimulation of the subterranean zone 102, determine locations of balls 116 in the tubing string 120 based on one or more operating conditions. The operating conditions may include one or more of the following: flow rate, pressure, temperature, length of tubing string 120, and/or other parameters. In some implementations, the monitoring system 114 may mark or otherwise identify when the ball 116 enters the tubing string 120 and the corresponding pressure spike minutes later indicates when the ball 116 has seated. During fracturing operations, the system 114 may measure the total volume of fluid that is pumped during this time interval. The system 114 may subtract the seating volume measurement minus the ball release measurement. From this calculation, the system 114 may determine how much fluid was used to seat the ball 116 and determine how much fluid should have been used (volume of pipe from surface to ball seat). In some cases, the volumes measured may be smaller then the calculated pipe volume, which may indicate that the ball is falling ahead of the fluid. Using these measurements, system 114 may determine how far ahead and/or behind of the calculated volume the ball should be released to land on time. In some implementations, the monitoring system 114 includes one or more sensors 138 for detecting when a ball 116 enters the tubing string 120. The sensor 138 may detect balls based on one or more properties such as sound, magnetic characteristics, electrical characteristics, and/or others. For example, the sensor 138 may be an acoustic echo meter that detects sounds such as a ball 116 entering a tubing string 120. In these examples, the sensor 138 may be attached to the system 100 using a magnet and located, for example, on the last chicksan on the pump line before entering the wellhead, wellhead/casing/flange on the wellhead assembly under the pumping iron, and/or other locations. The sensor 138 may be connected to an amplifier to amplify the detected signal and/or recorder to memorialize the detected signals. In some implementations, the amplified audio output may connect the two wire leads from the audio headset jack to an existing digital channel (e.g., flow) on, for example, the instrument skid of a tech command center. The channel may be calibrated with a low meter factor to get a high resolution (e.g., 1 pulse/gallon). The monitoring system 114 may detect a signal spike when the ball 116 passes through, for example, the chicksan and/or pumping iron because the ball 116 may make an audible sound when colliding with a surface. In some implementations, the monitoring system 114 may include a speaker to present the audio signals to a user when the ball 116 enters the tubing string 120. The monitoring system 114 may execute or include one or more of the following: filtering background noise by using the volume control for a gain adjustment; using a pre-amplifier with a volume control that can simplify, for example, Marantz PMD 430 recorder; using an op amp circuit to amplify the signal as well as filter background noise; using a second pre-amplifier due to loss from headset speaker current draw; taping the sound for documentation; time tagging the recording to identify significant features; and/or others.

Figure 5A:
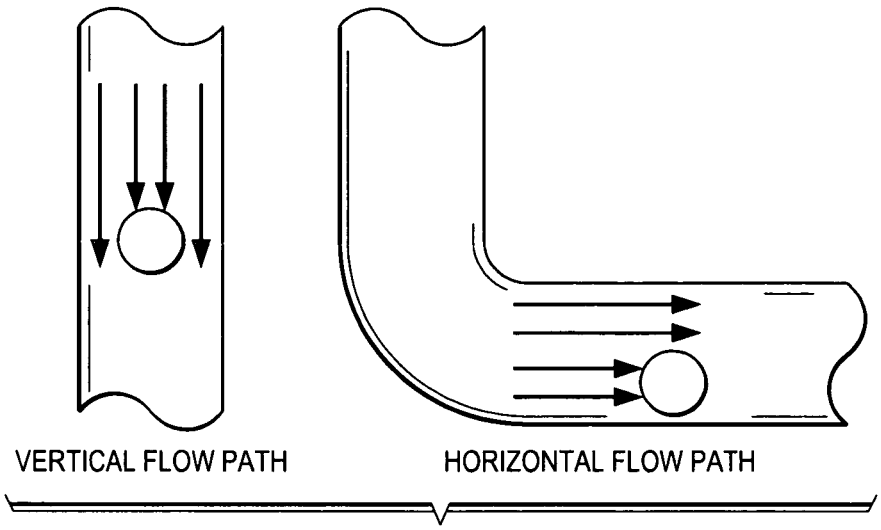
FIGS. 5A-C illustrate example graphs associated with determining ball locations.
Figure 5B:
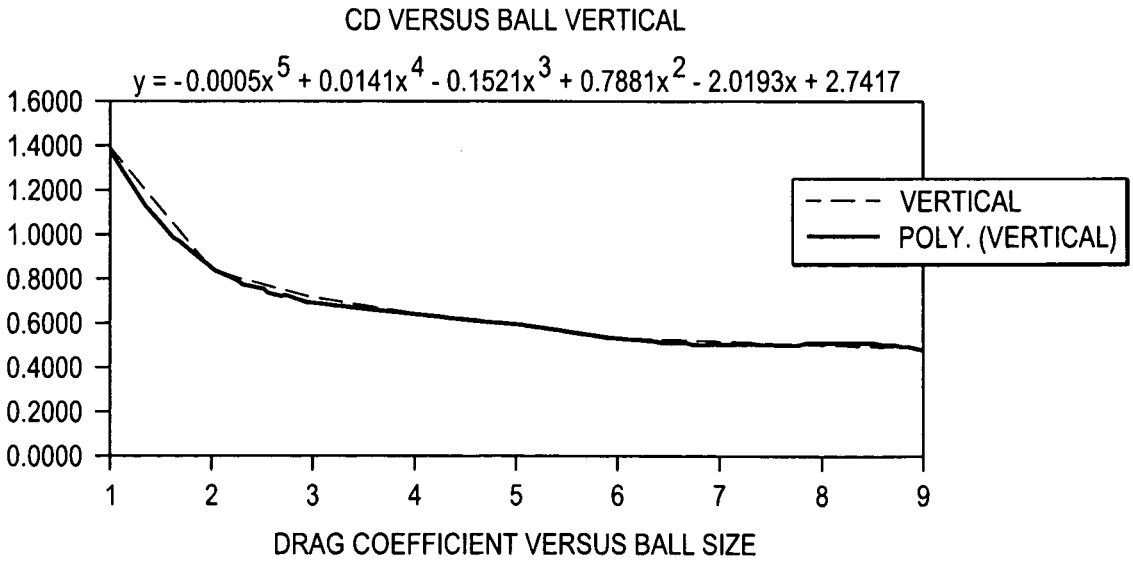
Figure 5C:
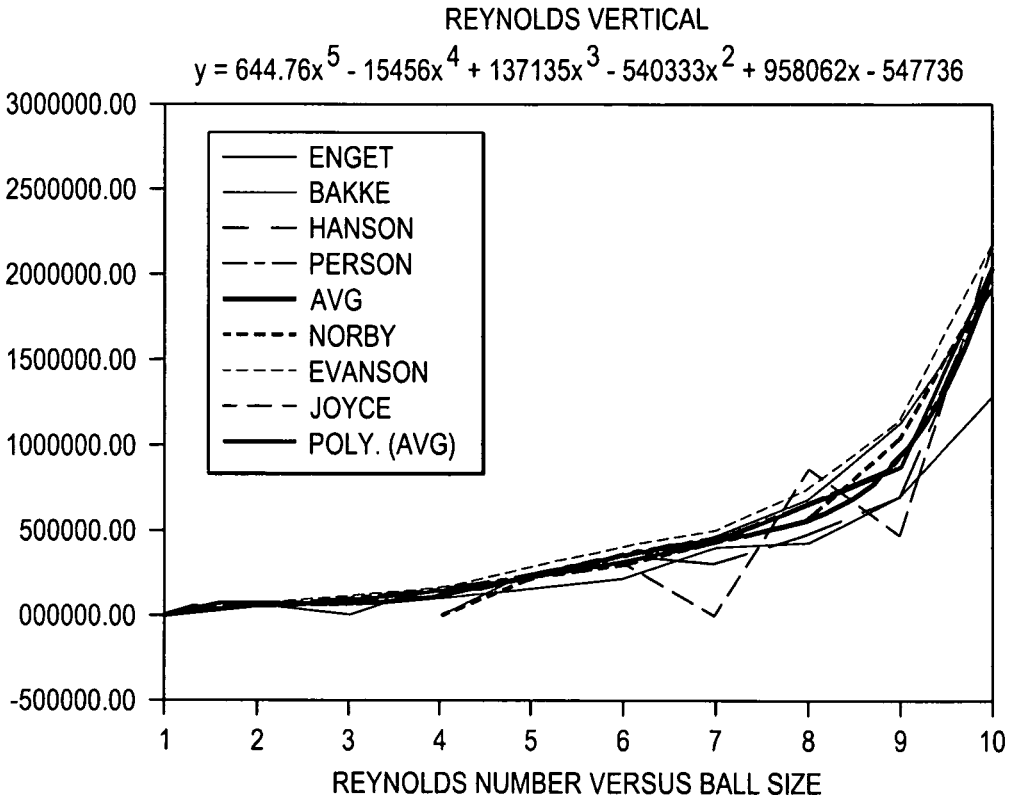

In some implementations, the monitoring system 114 may also detect or otherwise identify operating conditions of the stimulation process such as pressure, volume, duration, and/or other parameters. Using these parameters, the system 114 may determine a time that a ball 116 engages a corresponding sleeve 112. With regard to these determinations, the monitoring system 114 may use one or more equations, models, and/or other logical or mathematical expressions to determine a location of the ball 116. In general, the system 114 may estimate the amount of time for a ball dropped from the surface 117 to land on a seat of a sleeve 112. In some implementations, this calculation can be done as the ball free-falls, at a zero pump rate, or with the ball being pumped through the tubing string 120. The system 114 may provide one or more of the following advantages: reduced customer cost in fluid savings; reduced incidents with baffle blowout and/or ball disintegration; improved customer impressions through precise estimations; reduce error due to baffle blowout and/or ball disintegration if the ball speed exceeds a threshold; reduce costs associated with lost fluid; increase accuracy of calculators due to identified variables; and/or others. In some implementations, the system 114 determines a ball location based on one or more of the following variables: pump rate; casing size; liner size; ball size; vertical and horizontal distance; viscosity as well as ball; fluid density; distance between the dropper and well head; configuration of the iron; ball injection pump rate; and/or others. In some instances, the system 114 may assume that the ball 116 is substantially remains in the center of the flow stream in vertical sections of the tubing string 120 and is substantially decentralized in horizontal sections of the tubing string 120. (see FIGS. 5A-C) The system 114 may assume that the ball 116 may deflect off of small obstacles as it passes through the tubing string 120. In these instances, these disruptions may slow the ball 116 and/or disrupt flow patterns.

The drag force created on an object as it traverses through a fluid is typically expressed by the following equation:

$$F_D = \frac{1}{2}\rho u^2 C_D A$$

where $F_D$ is drag force, ρ is fluid density, $u^2$ is relative fluid velocity, $C_D$ is coefficient of drag, and A is effective area. In addition to this equation, the system 114 may include drag, or friction, created as the ball moves through the tubing string 120. The equation above is typically for an object in an open fluid and does not encompass the additional forces from the confined space. The system 114 may include the drag force into an encompassing equation, which may be highly dependent on other variables. For example, the force may depend on the drag coefficient, which may be dependent on fluid rate, Reynolds number, casing and/or ball size.

In some implementations, the system 114 can determine or otherwise identify a calculator based on empirical data with a mathematical equation background that maximizes, enhances, or otherwise increases the accuracy of determining the ball location. For example, the system 114 may use an iterative process to develop a final ball-drop calculator. To begin, the system 114 may identify a base equation that may be updated during the process. For example, the system 114 may include an excel spreadsheet that includes a log of times that the ball 116 took to seat and corresponding well schemes for those times. Next, the system 114 may generate or otherwise identify initial values for the drag coefficients. For example, two coefficients may be initially identified for each ball 116 for both the vertical and horizontal sections and adjusted to match the predicted time to the actual time. The system 114 may set up a control that could modify the drag coefficients for the jobs substantially simultaneously and chart the changes to estimate landing times. Based, at least in part, on these results, the system 114 may identify drag coefficients, graphs and/or equations having the best average error (see FIGS. 5B and 5C). In some implementations, the system 114 can generate a unique coefficient for every ball dropped.

The system 114 may use the data to generate two equations based on ball size. In these instances, the system 114 may combine the two equations to determine an expression for the coefficient as function of Reynolds and ball size. The system 114 may determine the accuracy of this final equation based, at least in part, on the jobs. In some implementations, the Reynolds number can be removed from the equations, so the coefficients were purely a function of ball size. In one of the example final steps, the system 114 may plug previously calculated coefficients were into the jobs to check accuracy. Since pump rate and time may not be accurately predicted, the system 114 may use the well schematic as input. When running the job, the system 114 may identify an initial pump rate, the duration (seconds from ball drop to decrease in rate), and/or the slower, or landing, rate. In response to at least these inputs, the system 114 may estimate a time such as seconds from the rate decrease until the ball 116 can be expected to seat the sleeve 112. The following tables illustrate example calculator values for making such estimates.

TABLE 1

| INPUT DATA Ball 10 | |
|---|---|
| Ball diameter | 3.50 |
| Pump Fluid Rate (initial BPM) | |
| Pump Fluid Rate (land BPM) | |
| Initial BPM Duration (sec) | |
| Land BPM Duration (sec) | |
| Pump Fluid Rate (AVG BPM) | 0.00 |
| Absolute Viscosity of the Completion Fluid (cP) | 1.00 |
| Density of the Completion Fluid (lb/gal) | 8.33 |
| Density of the Setting Ball (lb/in3) | 0.0639 |
| Vertical ID | 3.826 |
| Horizontal ID | 4.000 |
| Vertical Length (ft) | 0.00 |
| Horizontal Length (ft) | 0.00 |
| CALCULATIONS | |
| Velocity of the fluid in Vertical (ft/sec) | 0.00 |
| Velocity of the fluid in Horizontal (ft/sec) | 0.00 |
| Relative Velocity of the fluid in Vertical (ft/sec) | 1.21 |
| Relative Velocity of the fluid in Horizontal (ft/sec) | 0.00 |
| Kinematic viscosity of the fluid (ft^2/sec) | 0.0161 |
| Swept area of the ball | 9.6212 |
| Reynolds Number in Vertical | 0.00 |
| Reynolds Number in Horizontal | 0.00 |
| Coefficient of Drag in Vertical | 0.4785 |
| Coefficient of Drag in Horizontal | 0.4685 |
| Drag Force in Vertical (lbs) | 1.45 |
| Drag Force in Horizontal (lbs) | 0.00 |
| Ball weight (lbs) | 1.43 |
| Ball weight in the completion fluid (lbs) | 0.62 |
| Velocity of the ball in Vertical (ft/sec) | 0.01 |
| Velocity of the ball in Horizontal (ft/sec) | 0.00 |
| Time to seat (sec) | #DIV/0! |

TABLE 2

| Well Data | | | |
|---|---|---|---|
| Sleeve | Ball Size | Sleeve Depth | Hanger Depth |
| 1 | 1.25 | | |
| 2 | 1.50 | | |
| 3 | 1.75 | | |
| 4 | 2.00 | | |
| 5 | 2.25 | | |
| 6 | 2.50 | | |
| 7 | 2.75 | | |
| 8 | 3.00 | | |
| 9 | 3.25 | | |
| 10 | 3.50 | | |
| Viscosity of the Completion Fluid (cP) | | | |
| Density of the Completion Fluid (lb/gal) | | | |
| Density of the Setting Ball (lb/in3) | | | |
| Vertical ID | | | |
| Horizontal ID | | | |

The above tables are for illustration purposes only, and the system 114 may use some, none, or all of the identified values without departing from the scope of the disclosure.

In some aspects of operation, a user releases or adds into the treatment fluid 108 a ball 116 corresponding to a sleeve 112. In response to at least the ball 116 entering the tubing string 120, the sensor 138 detects a ball location and associated time. In connection with estimating a time the ball 116 engages the sleeve, the monitoring system 114 identifies one or more operating conditions of the stimulation process and the entry time. Based, at least in part, on these values, the monitoring system 114 may estimate, approximate, or otherwise determine the location of the ball 116 or a time that the ball engages the corresponding sleeve 112. In addition, the monitoring system 114 may identify an associated pressure drop corresponding to the treatment fluid entering the treatment zone 136. In these implementations, the monitoring system 114 may determine whether the ball 116 engages the sleeve within an appropriate time and volume as associated with the estimated time of arrival.

Figure 2A:
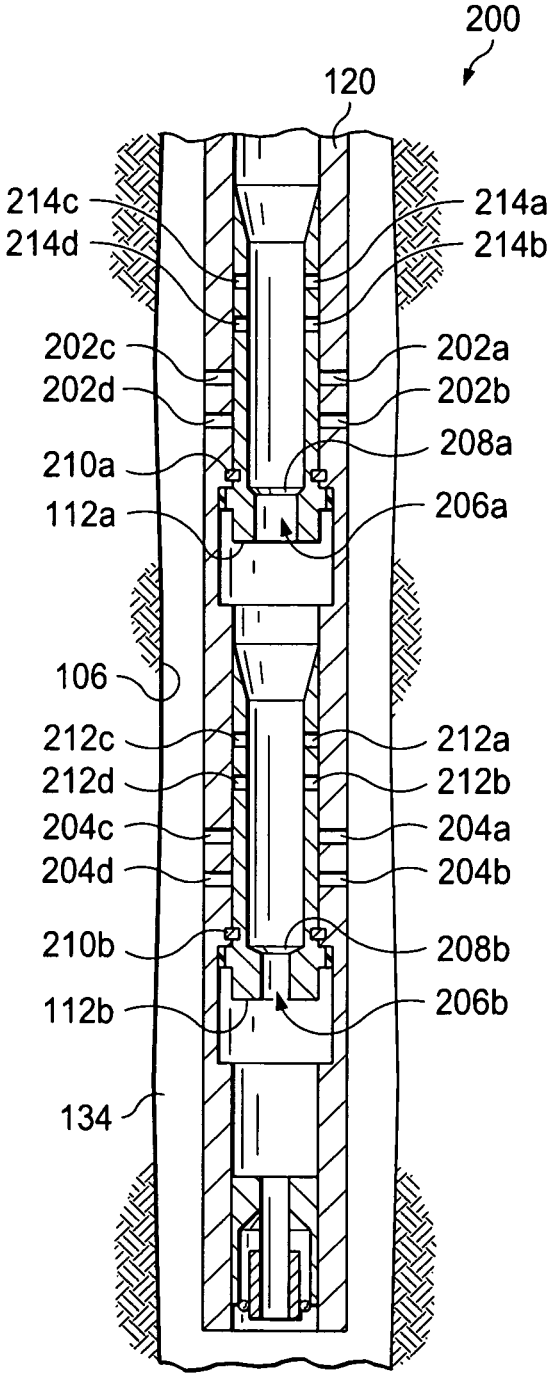
FIGS. 2A-C illustrate an example sleeve of FIG. 1.
Figure 2B:
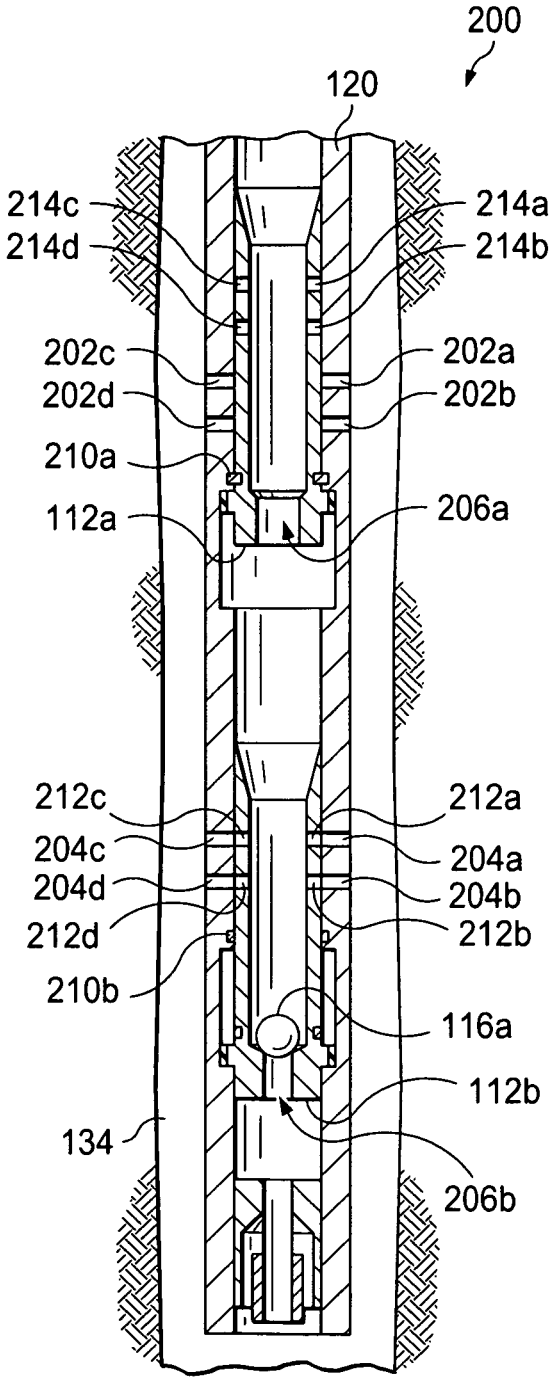
Figure 2C:
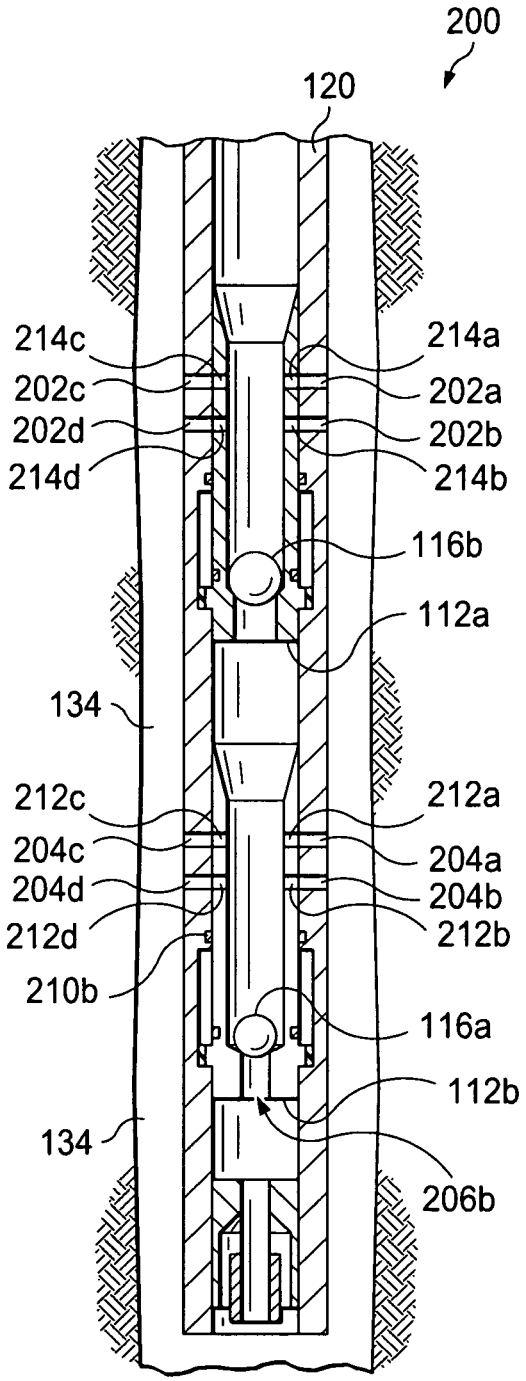

FIGS. 2A-C illustrate a portion 200 of the well system 100 including sleeve valves 112*a* and 112*b*. As shown in FIGS. 2A-C, the two sleeves 112*a* and 112*b* include perforations 202 and 204, respectively, for releasing treatment fluid from the interior of the tubing string 120 to the production zone 102. The perforations 202 and 204 are axially spaced apart along the tubing string 120 and may allow two different locations within the production zone 102 to be treated with the treatment fluid. The portion 200 in the FIGS. 2A-C differs in that the initial sealing device 116 must flow past the baffle seat 208*a* of at least one sleeve 112*a* before being seated on a subsequent sleeve 112*b*. As shown in FIG. 2B, the initial sealing device 116*a* must flow through the inner flow area 206*a* of the upper-most sleeve 112*a* before landing on the lower-most sleeve baffle seat 208*b*. To allow the initial sealing device 116*a* to pass the upper sleeve 112*a*, the baffle seat 208*a* of the upper sleeve 112*a* has a larger inner flow area 206*a* than the inner flow area 206*b* of the lower and subsequent baffle seat 208*b*. Thus, the inner flow areas 206 of the sleeves 112 are different sizes and progressively decrease in size with each sleeve 112. As shown in FIG. 2A, the tubing string 120 is installed with the sleeves 112 in the closed position such that none of the perforations 202 and 204 are open. As previously described, appropriate seals on the outside of the sleeves 112 may seal the perforations 202 and 204 from the interior of the tubing string 120.

To flow the treatment fluid into the treatment zone 136, a first sealing device 116*a* is inserted into the tubing string 120 and pumped downhole to the sleeve valve 112*b*. Again, the sealing device 116*a* may be any suitable device that may be pumped into the tubing string 120 and landed on the baffle seat 208*b* to form a fluid tight seal. As shown in FIGS. 2B and 2C, the sealing device 116 is a ball, but need not be limited to that configuration. As shown in FIG. 2B, the inner flow area 206*a* of the initial sleeve 112*a* is large enough to allow the initial sealing device 116*a* to pass through to the set sleeve 112*a*. The inner flow area 206*b* of the lower baffle seat 208*b*, however, is smaller such that the initial sealing device 116*a* lands on the lower baffle seat 208*b*, as previously described. Fluid pressure within the tubing string 120 is then increased to create a pressure differential across the lower sleeve baffle seat 208*b* such that the force acting on the sleeve 112*b* shears the sleeve shear pins 210*b* and moves the sleeve 112*b* relative to the tubing string 120. The lower sleeve 112*b* is thus moved from the initial closed position as shown in FIG. 2A to an open position as shown in FIG. 2B to establish fluid communication between the perforations 204 and the sleeve ports 212 of the lower sleeve 112*b*. Once in the open position, fluid is pumped in the tubing string 120 past the upper sleeve 112*a* and through the lower set of perforations 204 to treat the production zone 102 and enhance the production capabilities of the treatment zone 136.

Once wellbore treatment at the initial location is complete, a different location of the production zone 102 may then be treated. A different wellbore treatment fluid may be needed for the new location in the production zone 102. Additionally, it may not be desirable to perform any additional treatment procedures on the initial treatment zone 136. Thus, it may be desirable to isolate the initial treatment zone 136 already treated from wellbore treatment fluids in the tubing string 120 before treating the new location.

To isolate the already treated formation, another sealing device 116*b* is pumped down the tubing string 120 and into engagement with the baffle seat 208*a* of the upper sleeve 112*a* while the sleeve 112*a* is in the closed position. Because the inner flow area 206*a* of the upper sleeve 112*a* is larger than the lower sleeve 112*b*, the subsequent sealing device 116*b* is larger than the initial sealing device 116*a*. Once located in the baffle seat 208*a* of the upper sleeve 112*a*, fluid pressure within the tubing string 120 causes the subsequent sealing device 116*b* to form a seal against the baffle seat 208*a* that substantially prevents fluid flow through the inner flow area 206*a* of the upper sleeve 112*a*. Again, the sealing device 116*b* may be any suitable device that may be pumped into the tubing string 120 and landed on the baffle seat 208*a* to form a substantially fluid tight seal. As shown in FIGS. 2B and 2C, the sealing device 116*b* is a ball, but need not be limited to that configuration. Forming the seal with the sealing device 116*b* substantially prevents fluid flow past the upper sleeve 112*a* and may isolate the initial treatment zone 136 from any fluids in the tubing string 120 above the upper sleeve 112*a*.

Once isolated, wellbore treatment procedures may be performed without affecting the initially treated location. To treat the production zone 102 adjacent the perforations 202 covered by the upper sleeve 112*a*, fluid communication must be established between the production zone 102 and the tubing string 120 above the subsequent sealing device 116*b*. As shown in FIG. 2C, the upper sleeve 112*a* is initially in a closed position and held in place with sleeve shearing pins 210*a*. The upper sleeve 112*a* is then moved from the initial closed position as shown in FIG. 2B to an open position as shown in FIG. 2C. The upper sleeve 112*a* is moved to the open position by increasing the fluid pressure above the subsequent sealing device 116*b* and creating a pressure differential across the sleeve baffle seat 208*a* such that the force acting on the sleeve 112*a* shears the sleeve shear pins 210*a* and moves the upper sleeve 112*a* relative to the tubing string 120. Once in the open position, the sleeve ports 214 may allow fluid flow from the tubing string 120 through the upper set of the perforations 202 to treat the production zone 102 and enhance the production capabilities.

When the decision is made that wellbore treatment operations are complete, fluid pressure within the tubing string 120 is lowered to less than the fluid pressure of fluids in the production zone 102. Fluids from the production zone 102 may then be allowed to enter the tubing string 120 through all the perforations 202 and 204. When the fluid pressure is high enough from the flow of formation fluids in the tubing string 120, the sealing devices 116 are unseated from the baffle seats 208 and fluids from both above and below the upper sleeve 112*a* flow through the tubing string 120 to the surface 117. The sealing devices 116 are pumped by the formation fluids flowing in the tubing string 120 toward the surface 117. If the sealing devices 116 make it to the surface, appropriate equipment at the surface, such as a sealing device catcher, may be used to retrieve the sealing devices 116 from the fluid flow. Sometimes, however, the sealing devices 116 are destroyed before reaching the surface 117, and no retrieval may be necessary. Although FIGS. 2A-C only show two sets of perforations 202 and 204 and two sleeves 112, there may be as many sets of sleeve valves 112 as appropriate. There may also be an initially open set of casing ports (e.g., not associated with a sleeve assembly). Thus, the wellbore fluid treatment apparatus 100 is not limited by the implementation illustrated in FIGS. 2A-C.

Figure 3A:
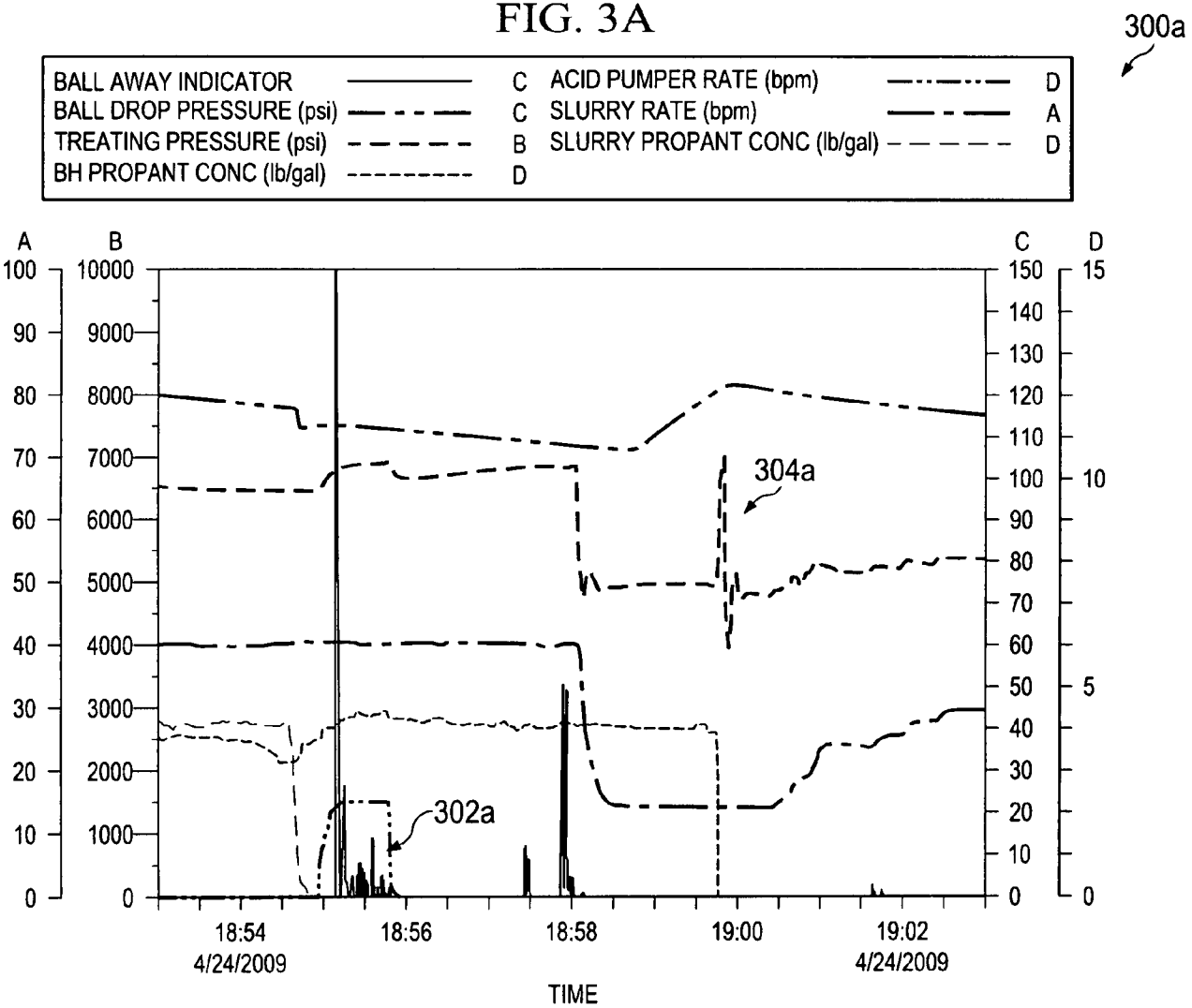
FIGS. 3A-I illustrate example graphs identifying different operating conditions during wellbore stimulation.
Figure 3B:
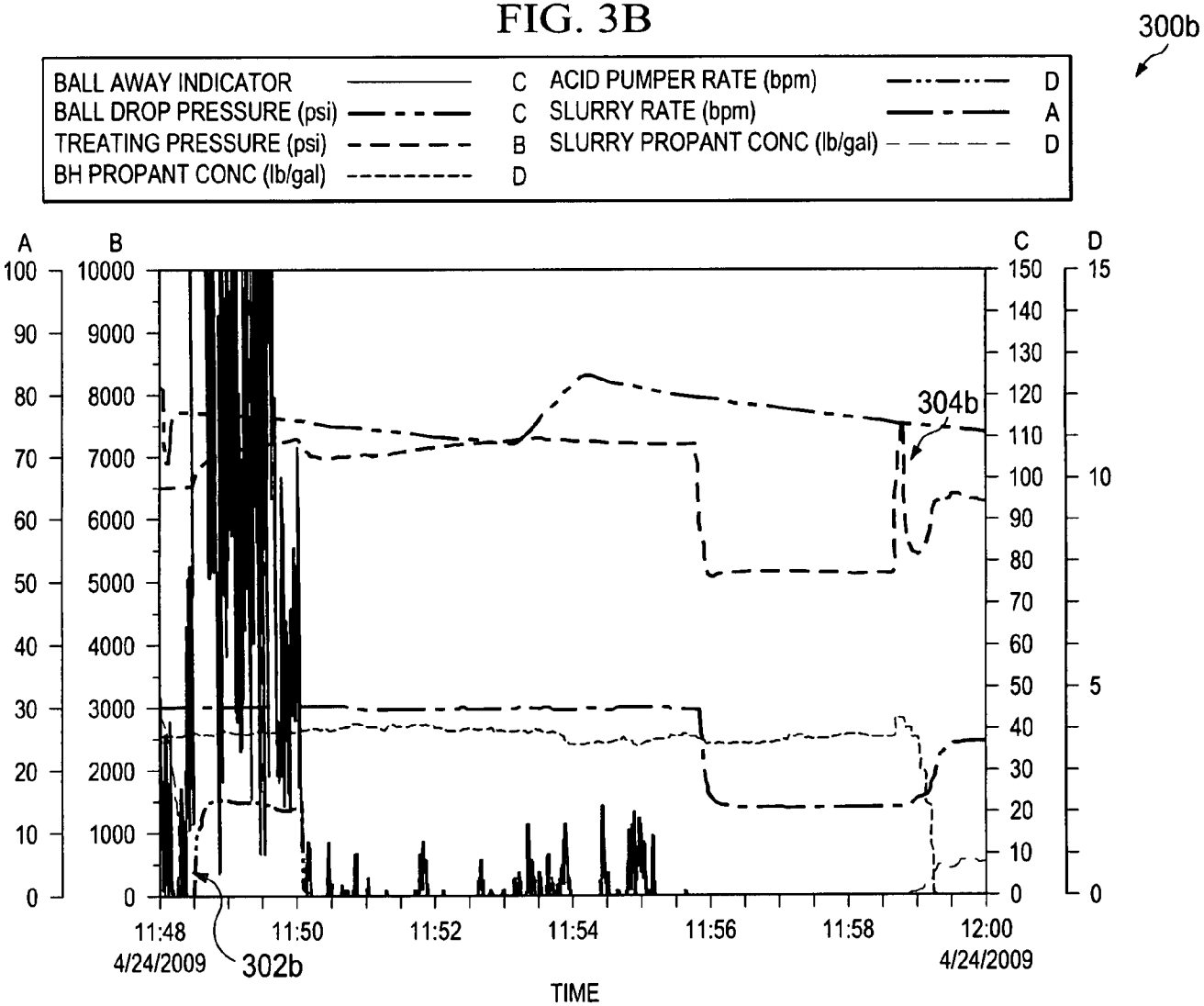
Figure 3C:
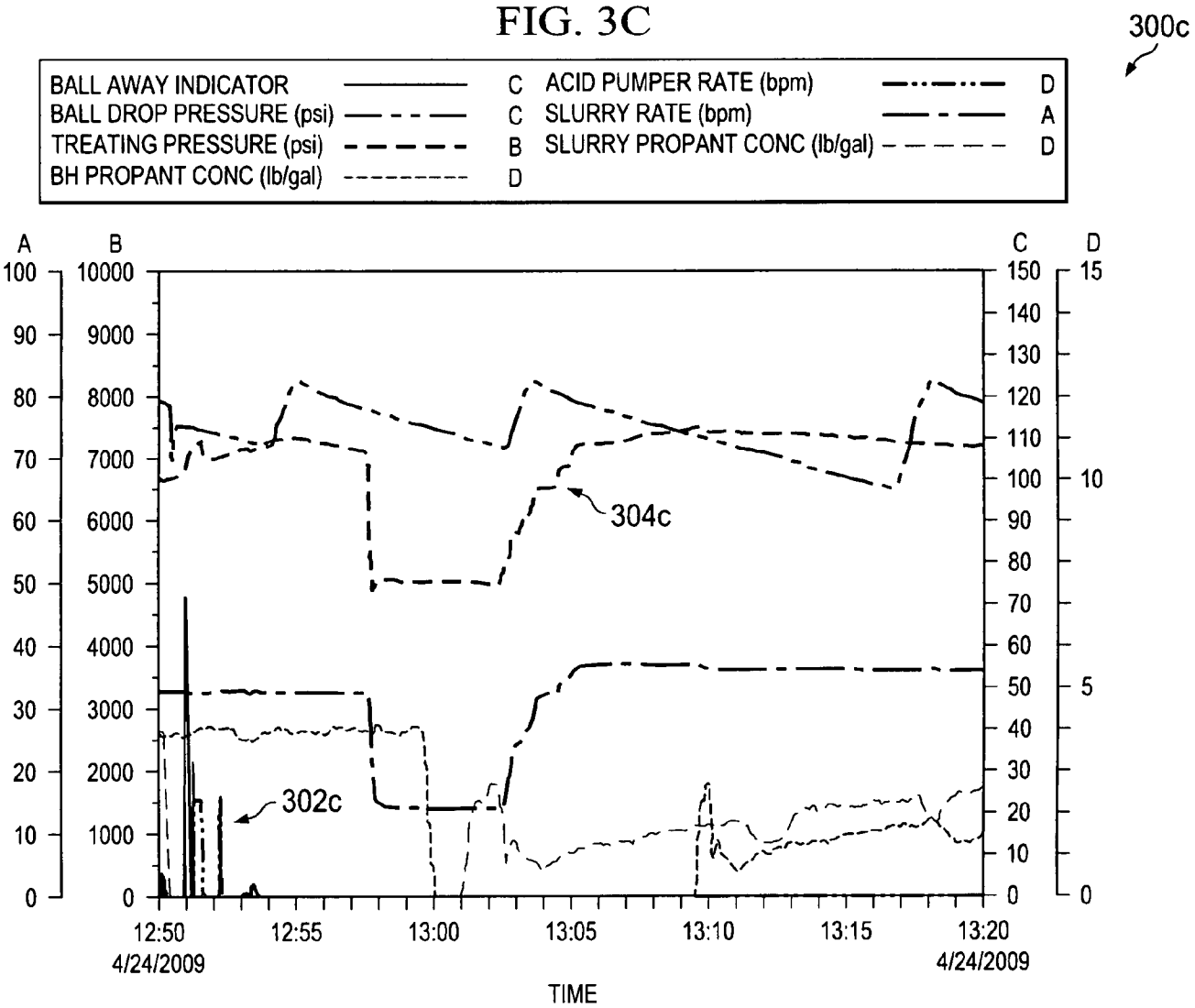
Figure 3D:
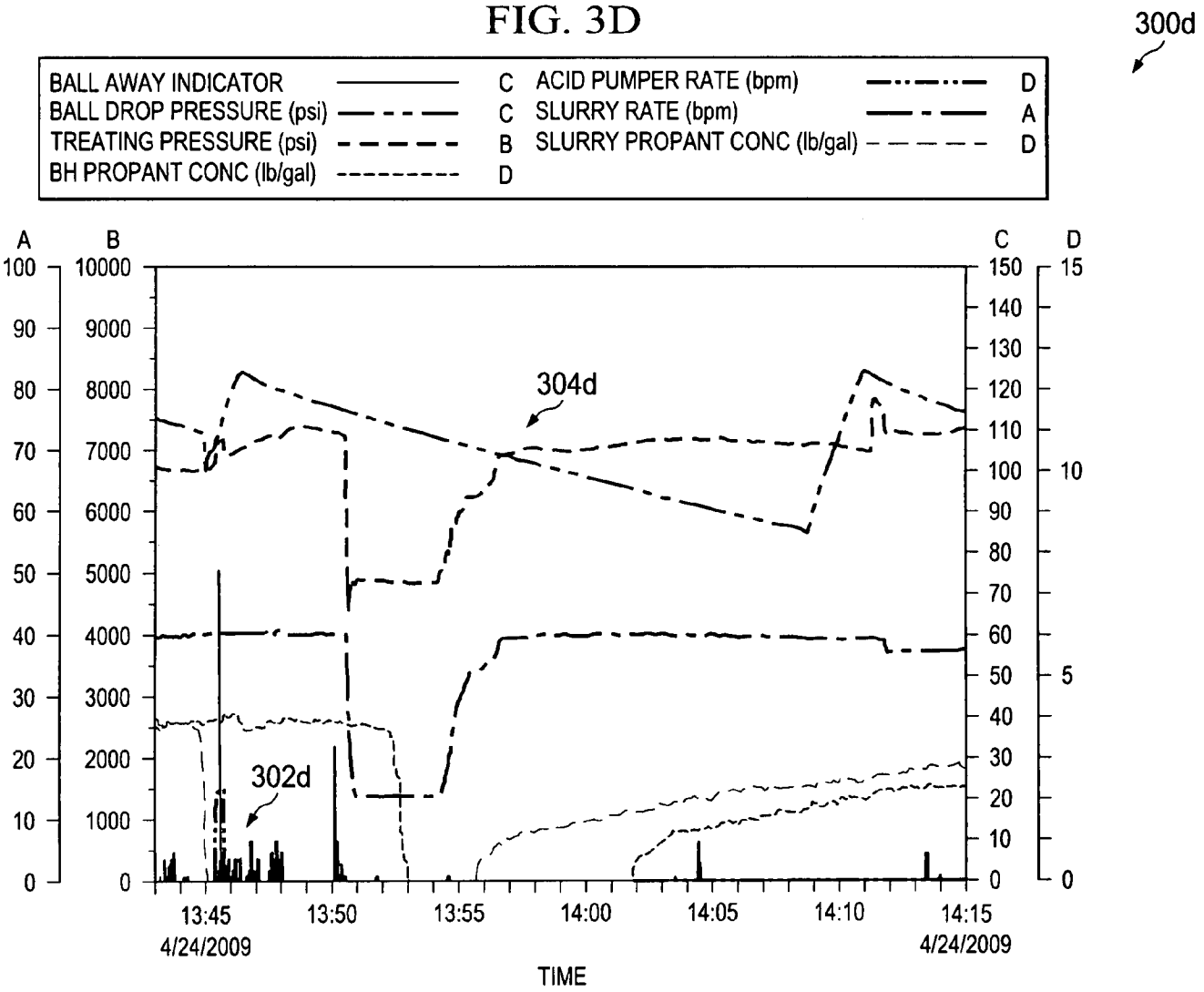
Figure 3E:
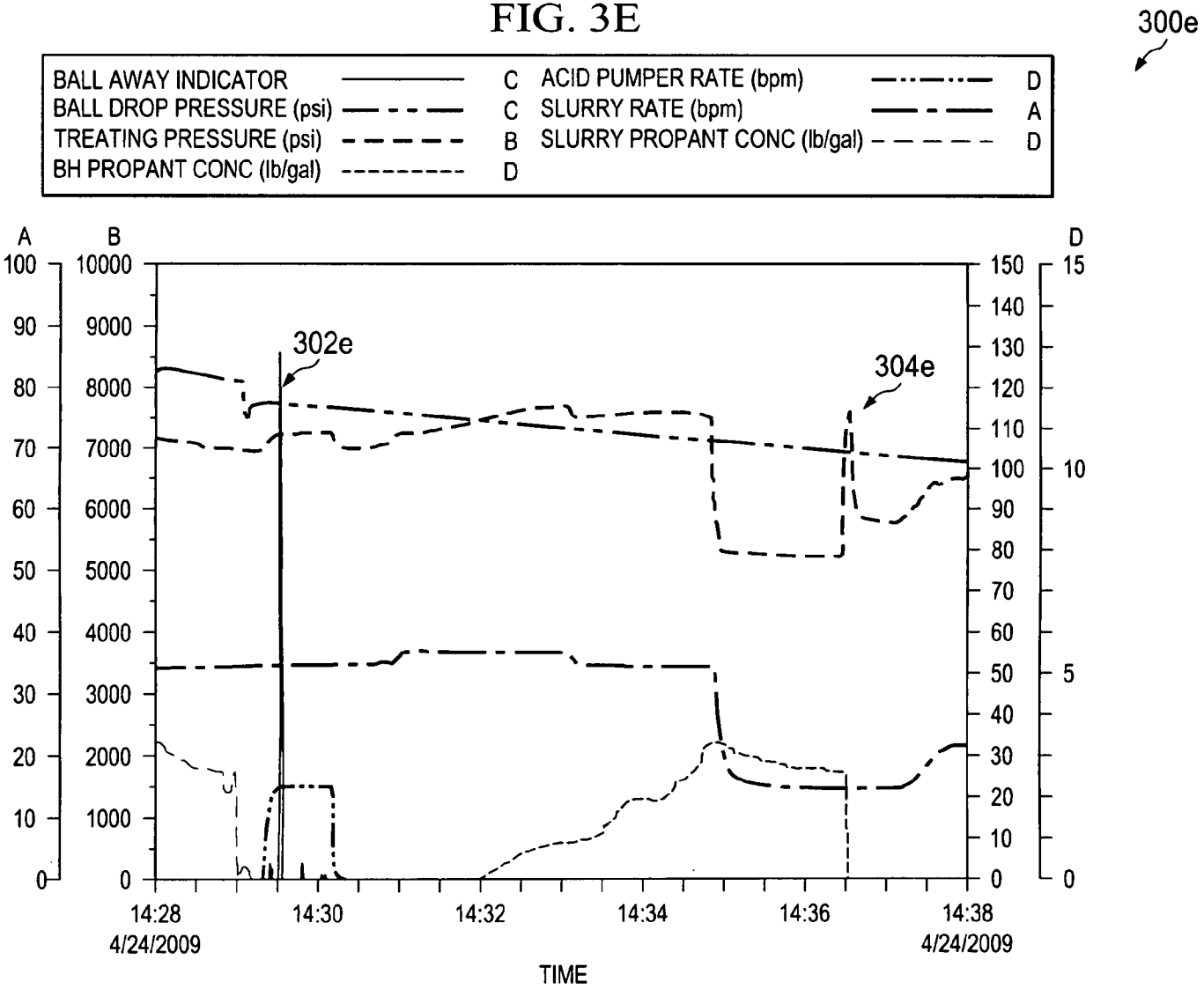
Figure 3F:
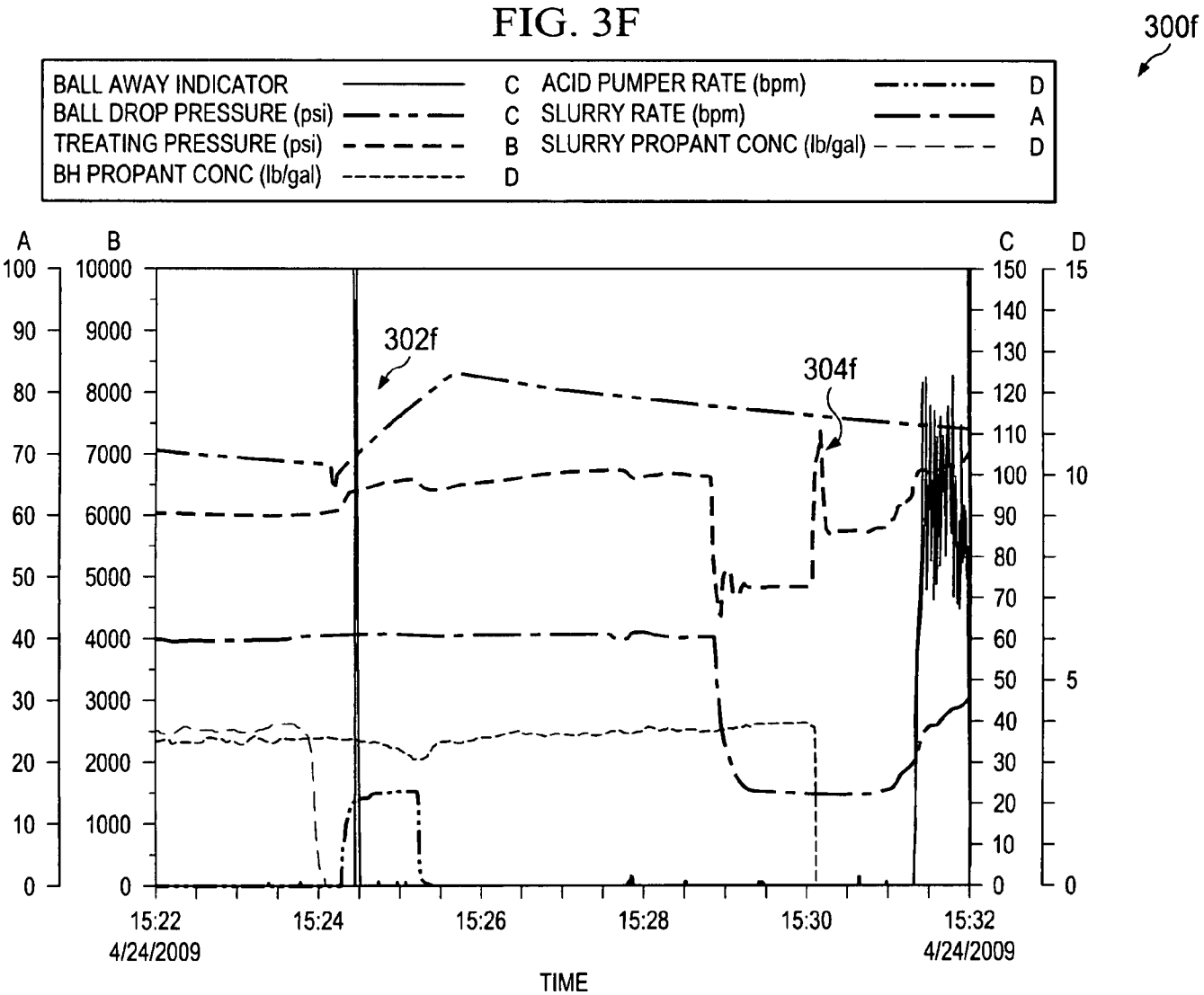
Figure 3G:
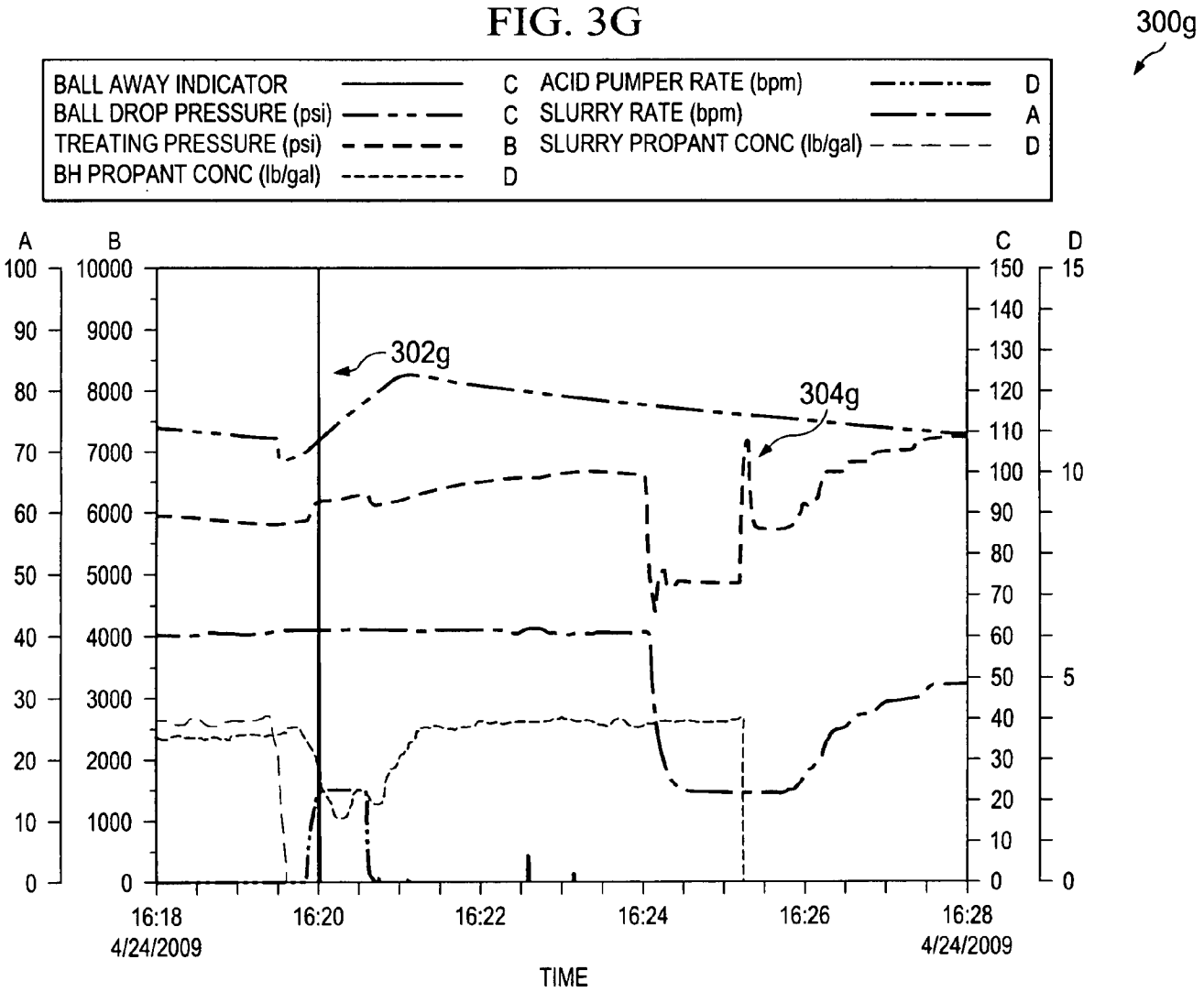
Figure 3H:
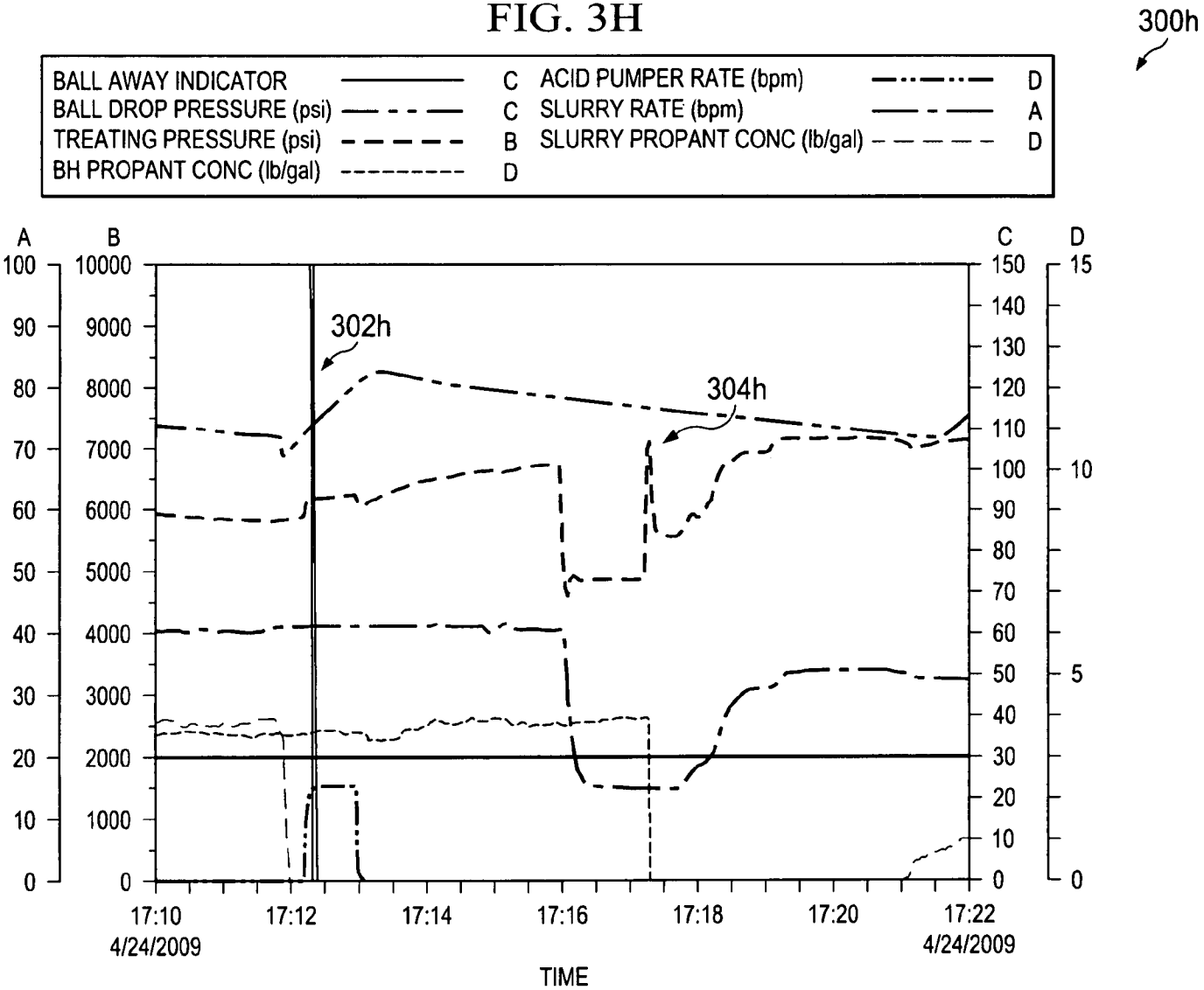
Figure 3I:
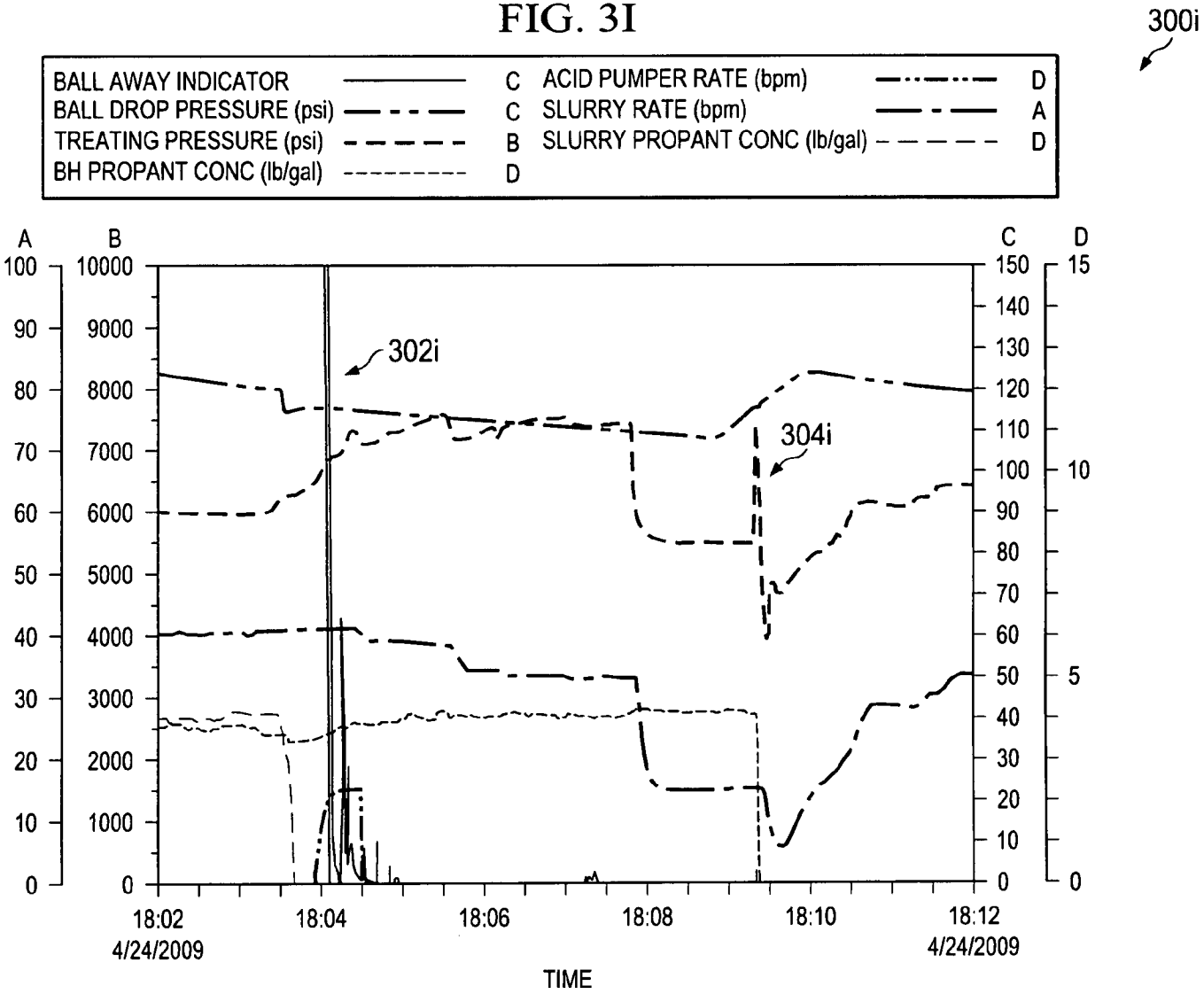

FIGS. 3A-I illustrates example graphs 300*a-i* that illustrate operating conditions of the well system 100. In this example implementation, eight balls are dropped during operating conditions for stimulating eight different portions of the subterranean zone 102. The graphs 300 include features for identifying a time when the ball 116 has left the wellhead and the time the ball 116 engages an associated sleeve 112. In these instances, the spikes 302*a-i* illustrate a period of time that a ball 116 passes through the wellhead. For example, the spike 302 may chart or otherwise identify when a ball 116 travels through iron proximate a sound transducer/microphone (e.g., sensor 138). The dips 304*a-i* in the graphs 300 may indicate a time that a ball 116 reaches a corresponding sleeve 112. For example, the dip 304 may indicate that a ball 116 has reached a stim sleeve 112 in a horizontal section of the wellbore 106. In addition, the dip 304 may indicate whether the ball 116 has reached the sleeve 112 within an acceptable time and/or volume. The graphs 300 are for illustration purposes only and the system 100 may determine locations of balls 116 using any appropriate process without departing from the scope of this disclosure. Referring to FIG. 3B, the graph 300*b* includes considerable noise proximate the spike 302*b* indicating adjustments to find the appropriate level of amplification. The ball drop indicate by the spike 302*b* is at approximately 11:49:00, and a speaker may be used to distinguish the background noise from the sound of the ball traveling through the tubing string 120. Referring to FIG. 3C, the graph 300*c* does not illustrate a distinctive spike 304*c* to illustrate engagement. Since the ball entered the tubing string 120 as indicated by the spike 302*c*, the system may determine whether to proceed with the stimulation. For example, a decision matrix may include the following: (1) continue on with the present stage assuming an undetected shift occurred; (2) discontinue the present stage and drop another ball with the assumption the previous ball failed (e.g., shattered); or (3) drop the next size ball to slide the next sleeve (highly unlikely) excepting in the event this was already the last ball to be dropped.

Figure 4:
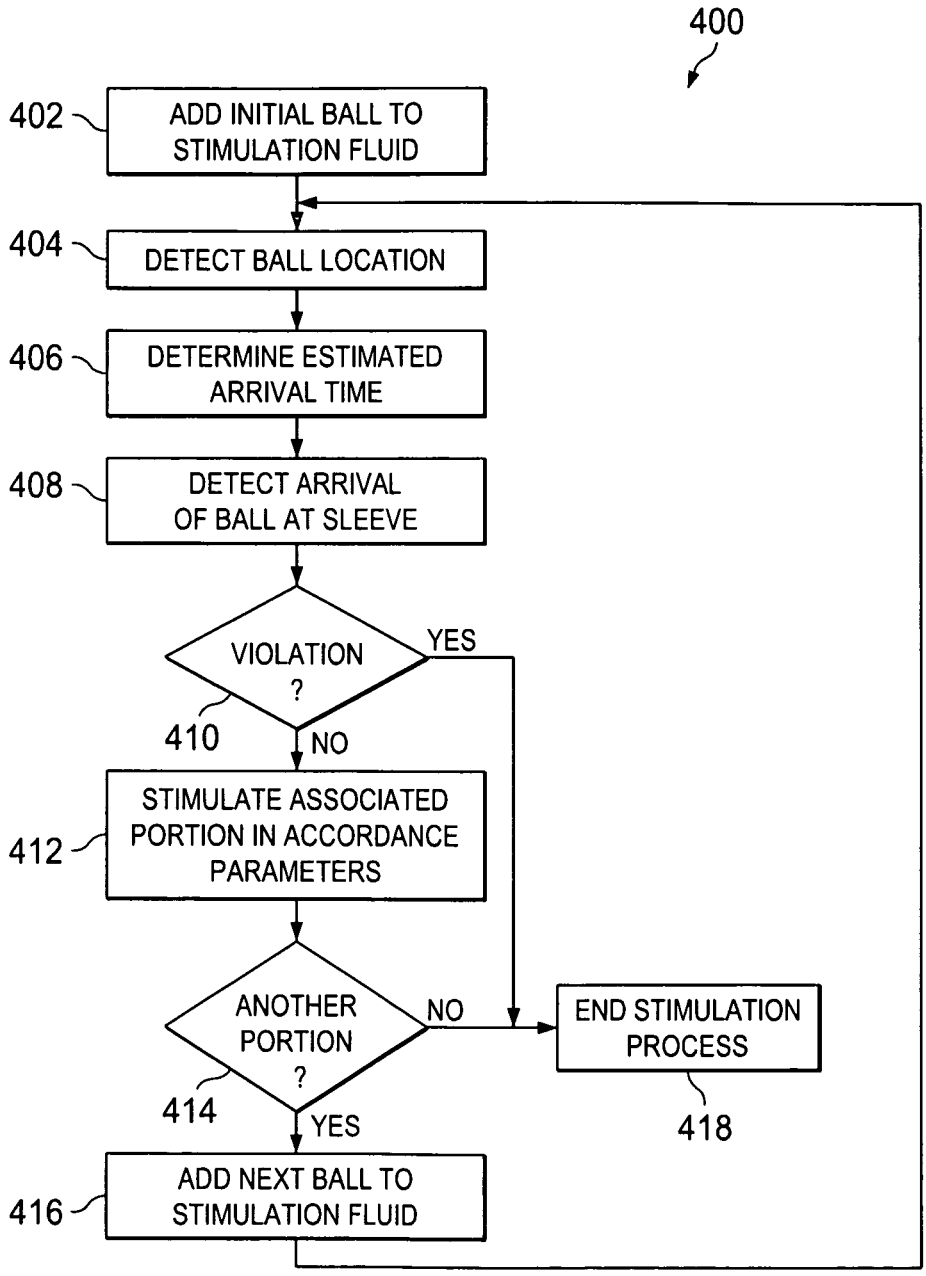
FIG. 4 is a flow chart illustrating an example method of managing stimulation of a subterranean zone.

FIG. 4 is a flow diagram illustrating an example method 400 for managing stimulation of different portions of a subterranean zone. The illustrated methods are described with respect to the well system 100 of FIG. 1, but these methods could be used by any other system. Moreover, the well system 100 may use any other techniques for performing these tasks. Thus, many of the steps in these flowcharts may take place simultaneously and/or in different order than as shown. The well system 100 may also use methods with additional steps, fewer steps, and/or different steps, so long as the methods remain appropriate.

Method 400 begins at step 402 where an initial ball is added to the stimulation fluid. For example, an initial ball 116 may be added to the stimulation fluid 108 before entering the tubing string 120. At step 404, a ball location is detected. In the example, the sensor 138 may detect the ball 116 passing through the wellhead based, at least in part, on detecting sound generated from the ball 116 contacting a surface of the tubing string 120. Next, at step 406, an estimated time of arrival is determined. Again in the example, the monitoring system 114 may determine the time of arrival at the sleeve 112 corresponding to the ball 116 based, at least in part, on the initial time and one or more operating conditions (e.g., pressure, volume, flow rate, distance). The arrival of the ball at the corresponding sleeve is detected at step 408. As for the example, the monitoring system 114 may detect pressure drop in the stimulation fluid corresponding to the ball 116 engaging the sleeve 112 and opening ports (e.g., 202, 204) to the subterranean zone 102. If a violation of the operating conditions occurs at step 410, then the stimulation process ends. In the example, the monitoring system 114 may determine that the detected arrival time violates the estimate time of arrival and, as a result, may determine an error in the stimulation process. In some instances, the engagement may not be detected, so in this case, the system 114 may determine or otherwise identify one or more process to select. For example, a decision matrix may include the following: (1) continue on with the present stage assuming an undetected shift occurred; (2) discontinue the present stage and drop another ball with the assumption the previous ball failed (e.g., shattered); or (3) drop the next size ball to slide the next sleeve (highly unlikely) excepting in the event this was already the last ball to be dropped. If a violation does not occur, then, at step 412, the associated portion of the subterranean zone is stimulated according to specified parameters. The specified operating conditions may identify a fluid volume, pressure, flow rate, duration, and/or other aspects associated with stimulating a treatment zone 136. If another portion of the subterranean zone will be stimulated at decisional step 414, then, at step 416, the next ball is added to the stimulation fluid. In the example, a ball 116 with a larger diameter than the previous ball 116 may be added to the stimulation fluid 108. If another portion is not available, then the stimulation process ends at step 418.

The specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer program products, i.e., one or more modules of computer program instructions tangibly stored on a computer readable storage device for execution by, or to control the operation of, data processing apparatus. In addition, the one or more computer program products can be tangibly encoded in a propagated signal, which is an artificially generated signal, e.g., a machine-generated electrical, optical, or electromagnetic signal that is generated to encode information for transmission to suitable receiver apparatus for execution by a computer. The computer readable storage device can be a machine-readable storage device, a machine-readable storage substrate, a memory device, or a combination of one or more of them.

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, a cross-platform runtime environment, or a combination of one or more of them. In addition, the apparatus can employ various different computing model infrastructures, such as web services, distributed computing and grid computing infrastructures.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Implementations of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described is this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other.

A number of embodiments of the invention have been described. Nevertheless, it will be understood that various modifications may be made without departing from the spirit and scope of the invention. Accordingly, other embodiments are within the scope of the following claims.

What is claimed is:

1. A method, comprising:

pumping stimulation fluid through a tubing string in a wellbore during a stimulation process, the tubing string including a plurality of sleeves with each associated with a different treatment zone of the subterranean zone;

detecting a time for each of a plurality of different sealers entering the tubing string, each of the plurality of different sealers associated with a different one of the plurality of sleeves;

estimating, for each of the plurality of different sealers, a time of arrival at a sleeve corresponding to each of the plurality of different sealers based, at least in part, on the associated entry time;

in response to each of the plurality of different sealers arriving at the corresponding sleeve, pumping stimulation fluid into a corresponding treatment zone in accordance with one or more specified parameters, each of the different treatment zones stimulated at different times during the stimulation process and for a specified period of time, wherein the stimulation fluid is continuously pumped when switching between different treatment zones;

determining, for at least one particular sealer of the plurality of different sealers, that an actual time of arrival of the particular sealer is different than the estimated time of arrival of the particular sealer;

based on the difference exceeding a threshold, determining that an error occurred in the stimulation process; and based on the determined errors, taking a corrective action for the stimulation process.

2. The method of claim 1, wherein the specified parameters include at least one of a volume, a pressure, a duration, or a rate.

3. The method of claim 1, wherein pumping stimulation fluid comprises continuously pumping stimulation fluid into different treatment zones independent of interrupting the stimulation process.

4. The method of claim 1, wherein detecting a time for each of a plurality of different sealers comprises detecting sounds generated by each of the plurality of different sealers contacting a surface of the tubing string.

5. The method of claim 1, wherein the plurality of different sealers comprise a plurality of balls with different diameters.

6. The method of claim 1, wherein each of the plurality of different sleeves form an opening to a treatment zone in response to at least receiving an associated sealer.

7. The method of claim 1, wherein the detected arrival time for each of the plurality of sealers is based, at least in part, on a change in fluid pressure of the stimulation fluid.

8. The method of claim 1, further comprising verifying operating conditions of the stimulation process based, at least in part, on a detected arrival time and the estimated arrival time.

9. The method of claim 1, wherein the corrective action comprises a corrective action for a particular treatment zone of the different treatment zones, the particular treatment zone associated with the particular sealer.

10. The method of claim 1, wherein the corrective action comprises at least one of:

circulating a next sealer of different size than the particular sealer into the tubing string; or circulating another sealer substantially similar in size to the particular sealer into the tubing string.

11. A method, comprising:

selectively positioning a sensor at least proximate an opening of a tubing string in a wellbore in connection with a stimulation process, the tubing string including a plurality of sleeves with each associated with a different treatment zone of the subterranean zone;

detecting a time an initial sealer enters the opening of tubing string using the sensor;

estimating, for each of the plurality of different sealers, a time of arrival at a sleeve corresponding to each of the plurality of different sealers based, at least in part, on the associated entry time;

in response to each of the plurality of different sealers arriving at the corresponding sleeve, pumping stimulation fluid into a corresponding treatment zone in accordance with one or more specified parameters, each of the different treatment zones stimulated at different times during the stimulation process, wherein the stimulation fluid is continuously pumped when switching between different treatment zones;

determining, for at least one particular sealer of the plurality of different sealers, that an actual time of arrival of the particular sealer is different than the estimated time of arrival of the particular sealer;

based on the difference exceeding a threshold, determining that an error occurred in the stimulation process; and based on the determined errors, taking a corrective action for the stimulation process.

12. The method of claim 11, further comprising detecting an entry time for each of a plurality of subsequent sealers entering the tubing string.

13. The method of claim 12, wherein the plurality of different sealers comprise a plurality of balls with different diameters.

14. The method of claim 11, wherein detecting a time for the initial sealer comprises detecting sounds generated by the initial sealer contacting a surface of the tubing string.

15. The method of claim 11, wherein the corrective action comprises a corrective action for a particular treatment zone of the different treatment zones, the particular treatment zone associated with the particular sealer.

16. The method of claim 11, wherein the corrective action comprises at least one of:

circulating a next sealer of different size than the particular sealer into the tubing string; or circulating another sealer substantially similar in size to the particular sealer into the tubing string.

17. A wellbore system, comprising:

a sensor configured to detect a time for each of a plurality of different sealers entering a tubing string inserted in a wellbore configured to pump stimulation fluid, the tubing string including a plurality of sleeves with each associated with a different treatment zone of the subterranean zone, each of the plurality of different sealers associated with a different one of the plurality of sleeves; and a stimulation system configured to estimate, for each of the plurality of different sealers, a time of arrival at a sleeve corresponding to each of the plurality of different sealers based, at least in part, on the associated entry time, in response to each of the plurality of different sealers arriving at the corresponding sleeve, pumping stimulation fluid into a corresponding treatment zone in accordance with one or more specified parameters, each of the different treatment zones stimulated at different times during the stimulation process, wherein the stimulation fluid is continuously pumped when switching between different treatment zones, and the stimulation system is further configured to:

determine, for at least one particular sealer of the plurality of different sealers, that an actual time of arrival of the particular sealer is different than the estimated time of arrival of the particular sealer;

based on the difference exceeding a threshold, determine that an error occurred in the stimulation process; and based on the determined errors, take a corrective action for the stimulation process.

18. The wellbore system of claim 17, wherein the wellbore is configured to continuously pump stimulation fluid into different treatment zones independent of interrupting the stimulation process.

19. The wellbore system of claim 17, wherein the sensor comprises an acoustic echo meter.

20. The wellbore system of claim 17, wherein the plurality of different sealers comprise a plurality of balls with different diameters.

21. The wellbore system of claim 17, wherein each of the plurality of different sleeves form an opening to a treatment zone in response to at least receiving an associated sealer.

22. The wellbore system of claim 17, wherein a detected time of arrival of each of the plurality of sealers is based, at least in part, on a change in fluid pressure of the stimulation fluid.

23. The wellbore system of claim 17, wherein the stimulation system is further configured to verify operating conditions of the stimulation process based, at least in part, on the detected arrival times and the estimated arrival times.

24. The wellbore system of claim 17, wherein the corrective action comprises a corrective action for a particular treatment zone of the different treatment zones, the particular treatment zone associated with the particular sealer.

25. The wellbore system of claim 17, wherein the stimulation system is further configured, based on the corrective action, to:

circulate a next sealer of different size than the particular sealer into the tubing string; or circulate another sealer substantially similar in size to the particular sealer into the tubing string.

* * * * *